US009080433B2

(12) United States Patent
Lanclos et al.

(10) Patent No.: US 9,080,433 B2
(45) Date of Patent: Jul. 14, 2015

(54) CONNECTION CARTRIDGE FOR DOWNHOLE STRING

(75) Inventors: Ronald Lanclos, Katy, TX (US); James Weekley, Katy, TX (US); Jason McCann, Cypress, TX (US); Mark Sloan, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 355 days.

(21) Appl. No.: 13/365,966

(22) Filed: Feb. 3, 2012

(65) Prior Publication Data

US 2012/0199352 A1 Aug. 9, 2012

Related U.S. Application Data

(60) Provisional application No. 61/439,217, filed on Feb. 3, 2011.

(51) Int. Cl.

| | |
|---|---|
| ***E21B 43/1185*** | (2006.01) |
| ***E21B 43/117*** | (2006.01) |
| ***F42D 1/05*** | (2006.01) |
| ***F42D 1/055*** | (2006.01) |
| *E21B 47/12* | (2012.01) |

(52) U.S. Cl.

CPC ..... *E21B 43/1185* (2013.01); *F42D 1/05* (2013.01); *E21B 43/117* (2013.01); *E21B 47/12* (2013.01)

(58) Field of Classification Search

CPC ..... E21B 43/1185; E21B 43/117; F42D 1/05; F42D 1/055

USPC ..... 166/298, 55, 65.1; 175/2, 4.55; 89/1.15; 361/248, 249; 102/308, 310, 311, 217, 102/218, 220, 320, 322, 202.5, 202.12, 102/202.14, 206

See application file for complete search history.

(56) References Cited

U.S. PATENT DOCUMENTS

| | | | | | |
|---|---|---|---|---|---|
| 2,821,136 | A | * | 1/1958 | Castel | 175/4.55 |
| 2,871,784 | A | * | 2/1959 | Blair | 175/4.55 |
| 3,010,396 | A | * | 11/1961 | Coleman | 175/4.55 |
| 3,086,589 | A | * | 4/1963 | McGowen, Jr. | 166/65.1 |
| 3,208,378 | A | * | 9/1965 | Boop | 175/4.55 |
| 3,246,707 | A | * | 4/1966 | Bell | 175/4.54 |
| 3,517,758 | A | * | 6/1970 | Schuster | 175/4.55 |
| 3,768,408 | A | * | 10/1973 | Hallmark | 102/320 |
| 3,773,120 | A | * | 11/1973 | Stroud et al. | 175/4.55 |
| 3,860,865 | A | * | 1/1975 | Stroud et al. | 324/508 |
| 4,007,796 | A | * | 2/1977 | Boop | 175/4.55 |
| 4,852,494 | A | * | 8/1989 | Williams | 102/263 |
| 4,886,126 | A | * | 12/1989 | Yates, Jr. | 175/4.54 |
| 5,436,791 | A | * | 7/1995 | Turano et al. | 361/253 |
| 5,756,926 | A | * | 5/1998 | Bonbrake et al. | 102/215 |
| 6,082,265 | A | * | 7/2000 | Sakamoto et al. | 102/206 |
| 6,164,375 | A | * | 12/2000 | Carisella | 166/65.1 |
| 6,182,750 | B1 | | 2/2001 | Edwards et al. | |
| 6,213,203 | B1 | | 4/2001 | Edwards et al. | |

(Continued)

*Primary Examiner* — Jennifer H Gay

(74) *Attorney, Agent, or Firm* — Bracewell & Giuliani LLP

(57) ABSTRACT

A cartridge assembly for use with a perforating system having a contact terminal that connects to a perforating signal line when inserted into a receptacle end of a perforating gun. A detonator may be included in an end of the cartridge assembly for initiating a detonating cord in the perforating gun. The cartridge assembly is a modular unit that replaces the manual connections made when assembling a string of perforating guns. The cartridge assembly may optionally include a controller switch for controlling current flow through the cartridge assembly.

12 Claims, 5 Drawing Sheets

(56) References Cited

U.S. PATENT DOCUMENTS

| | | | | |
|---|---|---|---|---|
| 6,283,227 | B1 * | 9/2001 | Lerche et al. | 175/4.55 |
| 6,354,374 | B1 | 3/2002 | Edwards et al. | |
| 6,604,584 | B2 * | 8/2003 | Lerche et al. | 175/4.55 |
| 6,752,083 | B1 * | 6/2004 | Lerche et al. | 102/202.7 |
| 6,779,202 | B1 | 8/2004 | Alldredge | |
| 6,962,202 | B2 | 11/2005 | Bell et al. | |
| 7,301,750 | B2 * | 11/2007 | DeVries et al. | 361/248 |
| 7,387,162 | B2 | 6/2008 | Mooney, Jr. et al. | |
| 7,487,833 | B2 | 2/2009 | Grigar et al. | |
| 7,536,942 | B2 * | 5/2009 | Bell | 89/1.151 |
| 7,565,927 | B2 * | 7/2009 | Gerez et al. | 166/250.01 |
| 7,565,930 | B2 * | 7/2009 | Seekford | 166/297 |
| 7,600,562 | B2 | 10/2009 | Christian | |
| 7,902,469 | B2 * | 3/2011 | Hurst | 200/81 R |
| 7,913,603 | B2 | 3/2011 | LaGrange et al. | |
| 8,006,779 | B2 | 8/2011 | Moore et al. | |
| 8,061,431 | B2 | 11/2011 | Moore et al. | |
| 8,074,737 | B2 | 12/2011 | Hill et al. | |
| 8,079,296 | B2 * | 12/2011 | Barton et al. | 89/1.15 |
| 8,136,439 | B2 * | 3/2012 | Bell | 89/1.15 |
| 8,186,435 | B2 * | 5/2012 | Seekford | 166/298 |
| 8,302,523 | B2 * | 11/2012 | Bell | 89/1.15 |
| 8,369,063 | B2 * | 2/2013 | Vicente | 361/250 |
| 8,490,686 | B2 * | 7/2013 | Rodgers et al. | 166/55.1 |
| 8,661,978 | B2 * | 3/2014 | Backhus et al. | 102/202.3 |
| 2002/0062991 | A1 * | 5/2002 | Farrant et al. | 175/4.55 |
| 2005/0252403 | A1 * | 11/2005 | DeVries et al. | 102/200 |
| 2007/0074624 | A1 * | 4/2007 | Bell | 89/1.15 |
| 2007/0125540 | A1 * | 6/2007 | Gerez et al. | 166/298 |
| 2008/0202325 | A1 * | 8/2008 | Bertoja et al. | 89/1.151 |
| 2010/0000789 | A1 * | 1/2010 | Barton et al. | 175/2 |
| 2010/0212480 | A1 * | 8/2010 | Bell | 89/1.15 |
| 2011/0024116 | A1 * | 2/2011 | McCann et al. | 166/297 |
| 2011/0271823 | A1 * | 11/2011 | Vicente | 89/1.15 |
| 2012/0111217 | A1 * | 5/2012 | Bell | 102/262 |
| 2012/0181012 | A1 * | 7/2012 | Strickland | 166/55 |
| 2012/0199031 | A1 * | 8/2012 | Lanclos | 102/206 |
| 2012/0199352 | A1 * | 8/2012 | Lanclos et al. | 166/297 |
| 2013/0014990 | A1 * | 1/2013 | Barton et al. | 175/2 |
| 2013/0125772 | A1 * | 5/2013 | Backhus et al. | 102/206 |
| 2013/0133889 | A1 * | 5/2013 | Schacherer et al. | 166/297 |

* cited by examiner 44
42
46
15
48
10
14
24
36
38
40

CONNECTION CARTRIDGE FOR DOWNHOLE STRING

RELATED APPLICATIONS

This application claims priority to and the benefit of U.S. Provisional Application Ser. No. 61/439,217, filed Feb. 3, 2011, the full disclosure of which is hereby incorporated by reference herein.

BACKGROUND OF THE INVENTION

1. Field of Invention

The invention relates generally to the field of oil and gas production. More specifically, the present invention relates to a modular apparatus for providing communication between members of a downhole string. Yet more specifically, the present invention relates to a cartridge inserted into an end of a perforating gun equipped with a receptacle or contact at both ends for connection to a signal line through a perforating gun string.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length, but typically shorter in a wireline application. In FIG. 1 an example of a prior art perforating system 10 is shown disposed in a wellbore 12 and made up of a string of perforating guns 14 connected in series. Typically, subs 15 may connect adjacent guns to one another. The perforating system 10 is deployed from a wireline 16 that spools from a service truck 18 shown on the surface 20. Generally, the wireline 16 provides a raising and lowering means as well as communication and control connectivity between the truck 18 and the perforating system 10. The wireline 16 is threaded through pulleys 22 supported above the wellbore 12. In some instances, derricks, slips and other similar systems are used in lieu of a surface truck for inserting and retrieving the perforating system into and from a wellbore. Moreover, perforating systems may also be disposed into a wellbore via tubing, drill pipe, slick line, coiled tubing, to mention a few.

Included with each perforating gun 14 are shaped charges 24 that typically include a housing, a liner, and a quantity of high explosive inserted between the liner and the housing. When the high explosive in a shaped charge 24 is detonated, the force of the detonation collapses the liner and ejects it from one end of the shaped charge 24 at very high velocity in a pattern called a "jet" 26. The jet 26 perforates casing 28 that lines the wellbore 12 and cement 30 and creates a perforation 32 that extends into the surrounding formation 34.

Shown in FIGS. 2A-D are sectional views of the prior art perforating gun 14 of FIG. 1. As shown, the shaped charges 24 are typically connected to a detonating cord 36, which when detonated creates a compressive pressure wave along its length that initiates detonation of the shaped charges 24. A detonator 38 is typically used to set off detonation within the detonation cord 36. In FIG. 1, the detonator 38 is shown in a firing head 40 provided in the string of perforating guns 14. Initiating detonation of the detonation cord 36 generally takes place by first sending an electrical signal from surface 20 to the detonator 38 via the wireline 16. Referring back to FIGS. 2A-D, an upper connection sub 42 contains a terminal 44 for receiving signals transmitted along the wireline 16. A signal line 46 attaches to the terminal 44 and conveys signal(s) from the wireline 16 to the remaining portions of the perforating system 10, including the detonator 38. Multiple connectors 48 are used to make up the signal line 46 through the successive connecting subs 15 and perforating guns 14. The signal through the signal line 46 initiates high explosive in the detonator 38 that transfers to the attached detonation cord 36. Detonators 38 may sometimes be provided within connecting subs 15 for transferring the detonating charge along the entire string of perforating guns 14. Without proper continuity between the wireline 16 and detonator(s) 38, the shaped charges 24 cannot be detonated. However, failure points in the signal line 46 are introduced with each connector 48.

Generally the detonators are connected to the detonating cords in the field just prior to use. Thus they are shipped to the field with the electrical portions and high explosive coupled together in a single unit. Because of the risks posed by the high explosives and the threat of a transient electrical signal, shipment and storage of the detonators is highly regulated, this is especially so when being shipped to foreign locations. Additional problems may be encountered in the field when connecting detonators to the detonating cord. Perforating guns when delivered to the field generally have the shaped charges and detonating cord installed; to facilitate detonator connection some extra length of detonating cord is provided within the gun. Connecting the detonator to the detonating cord involves retrieving the free end of the detonating cord and cutting it to a desired length then connecting, usually by crimping, the detonator to the detonating cord. These final steps can be problematic during inclement weather. Additionally, these final steps fully load a perforating gun and thus pose a threat to personnel in the vicinity. Accordingly benefits may be realized by reducing shipping and storage concerns, increasing technician safety, and minimizing the time required to finalize gun assembly in the field.

SUMMARY OF INVENTION

Disclosed herein is an example of a perforating string insertable into a wellbore. In this example the perforating string is made up of a perforating gun having an upstream end with a receptacle fitting, a signal line with an end electrically connected to the receptacle fitting. Included with the example perforating string is a cartridge sub having a connector inserted into electrical connection with the receptacle fitting, a detonator in the cartridge sub and having a detonating end adjacent to and directed towards the upstream end, and a lead line in the cartridge sub having an end in selective communication with an electrical source and another end in communication with an inlet to the detonator. Optionally, the connector is an annular member that circumscribes a downstream end of the cartridge sub, and wherein the connector coaxially inserts into the receptacle fitting. In an embodiment, the perforating string further includes a switch in the lead line for selectively regulating electricity to the detonator. In this example, a ground lead is optionally included that is connected between the detonator and the switch, wherein the switch selectively communicates the ground lead to ground. In one example, the switch, the lead line, and the detonator are provided within an elongated body that coaxially inserts within an annular housing to define the cartridge sub. In one optional embodiment, further included with the perforating string is a transfer lead line having an end in selective communication with the electrical source and another end in communication with the connector for selectively providing communication between the electrical source and the signal line. A downstream cartridge sub may also optionally be included that has an inlet line in electrical communication with the signal line, an outlet lead line in communication with a bridge plug assembly, so that when an electrical signal is applied to the signal line, the electrical signal is transferred through the downstream cartridge sub to the bridge plug assembly for deploying a bridge plug in the bridge plug assembly.

Also provided herein is an example of a connector assembly for connecting an upstream perforating gun to a downstream perforating gun. In one example the connector assembly includes an annular housing, an elongated cartridge body inserted within the housing, an annular connector provided on a downstream end of the body and inserted into electrical contact with a receptacle in the downstream perforating gun, a detonator in the cartridge body for initiating a detonating cord in the perforating gun, and a lead line in the cartridge body having an end in selective communication with an electrical source and another end electrically connected to the connector. Optionally, a switch may be included in the body that is connected to the lead line and to an inlet line on the detonator. Also further Optionally included is an outline line that connects between the switch and the detonator, and a ground line that connects between the switch and ground, so that when a detonation signal and detonation current is sent to the switch, the inlet line, outlet line, and ground line form a circuit for flowing current through the detonator for initiating detonation of the detonator and the detonating cord.

An example method of perforating is provided herein that in one example includes providing a perforating gun with shaped charges, a detonation cord, a receptacle connection, and a signal line in communication with the receptacle connection. A cartridge sub is also provided that has an upstream end, a downstream end, a connector in the downstream end, and a lead line electrically connected to the connector. In the example method, the connector is connected with the signal line by inserting the downstream end of the cartridge sub into the receptacle connection, the shaped charges are detonated by providing a detonation signal to the detonator. In one example, the step of providing a detonation signal to the detonator includes directing electricity from an electrical source to an inlet line connected to the detonator. Optionally in the method, a switch is provided in the cartridge sub for providing electrical communication between the electrical source and the detonator, and for providing electrical communication between an outlet line on the detonator and ground for completing an electrical circuit through the detonator. In one example of the method, the perforating gun is a downstream perforating gun. In this example, further includes is a step of diverting some of the electricity from the electrical source through the lead line, to the connector and the receptacle for initiating detonation of shaped charges in a perforating gun downstream of the downstream perforating gun.

BRIEF DESCRIPTION OF DRAWINGS

Some of the features and benefits of the present invention having been stated, others will become apparent as the description proceeds when taken in conjunction with the accompanying drawings, in which.

Figure 1:
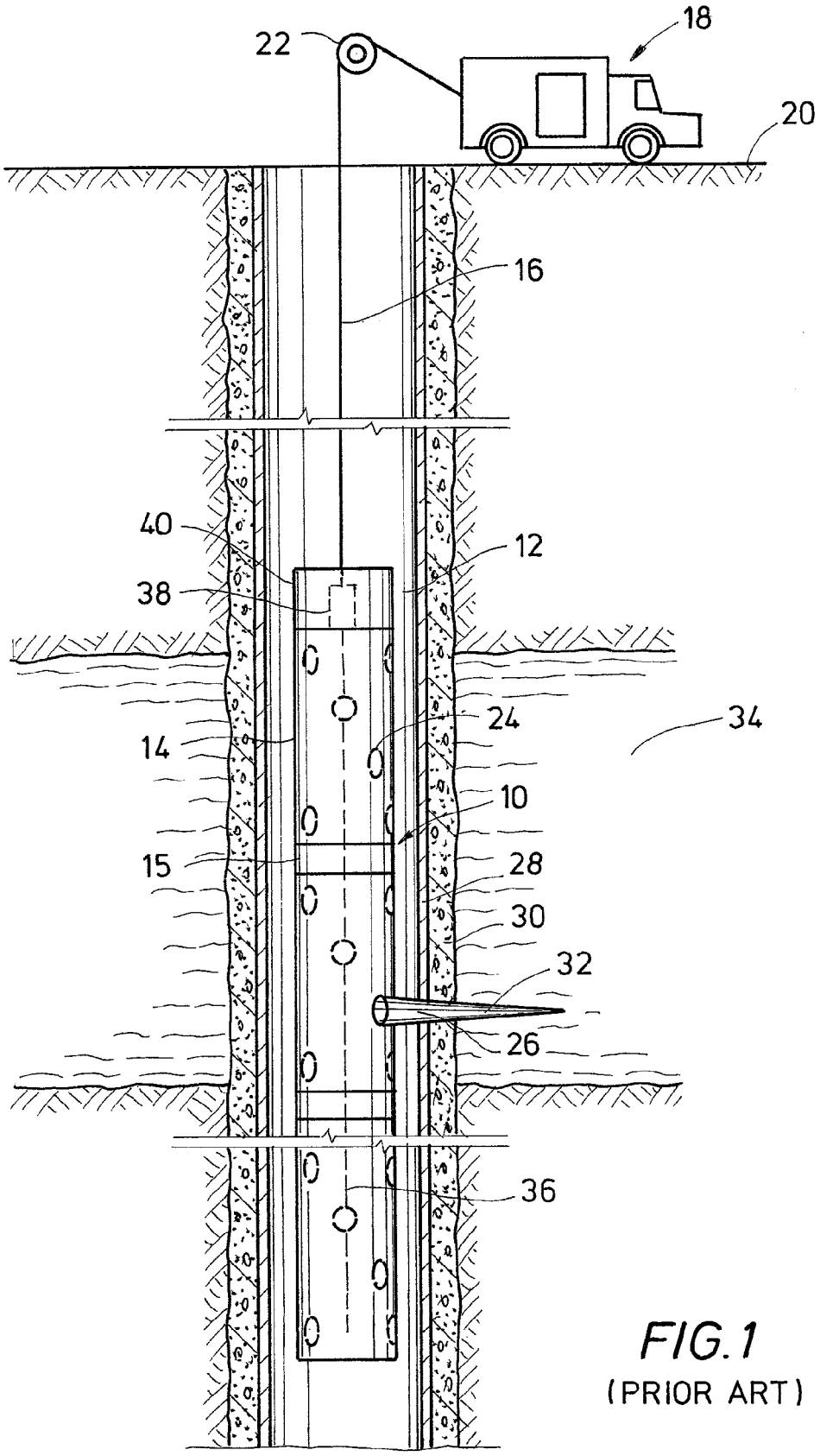
FIG. 1 (PRIOR ART)
FIG. 1 is a partial sectional side view of a prior art perforating system in a wellbore.
Figures 2A, 2B:
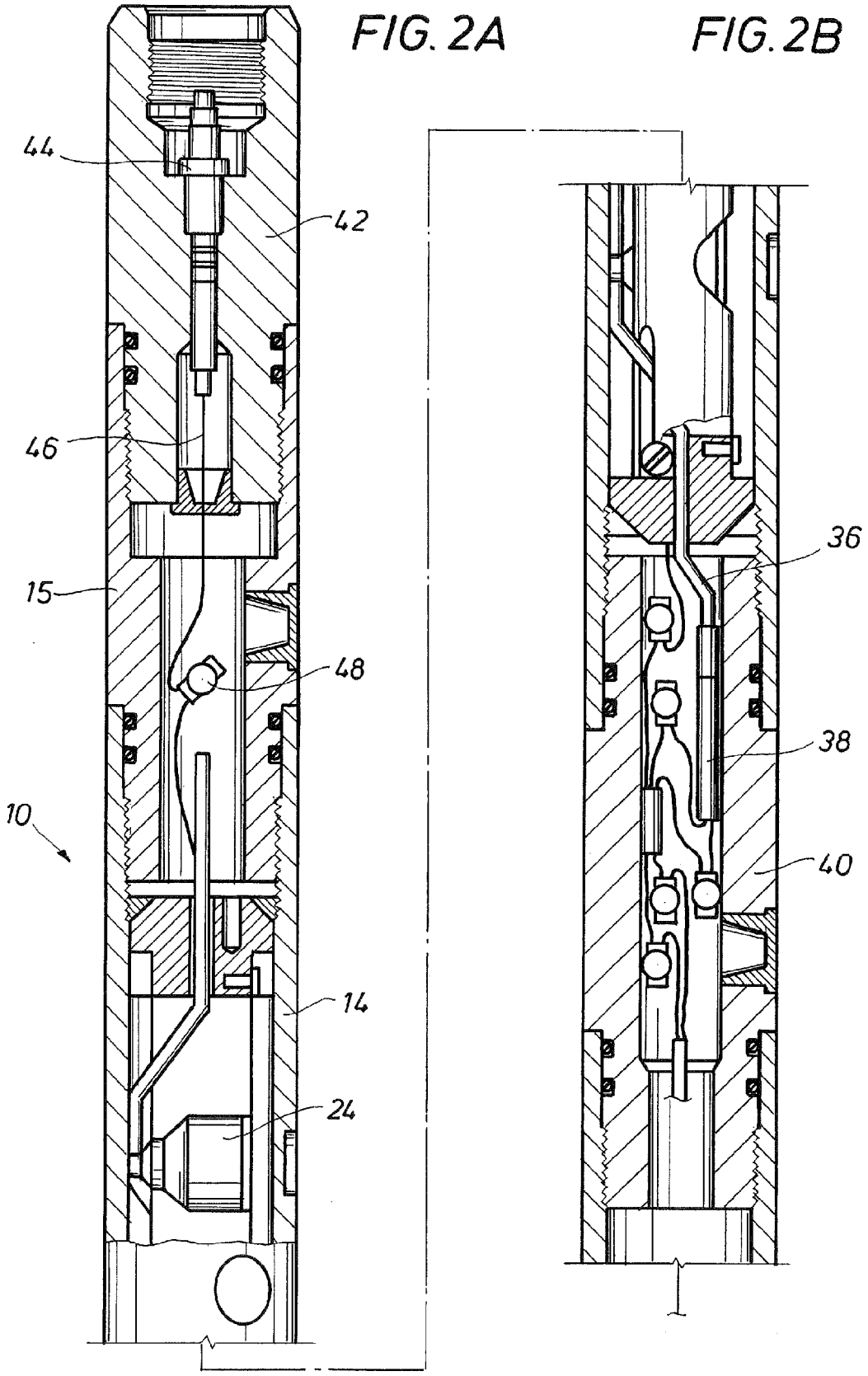
FIGS. 2A-D are side sectional views of a portion of a perforating string of FIG. 1.
Figure 2C:
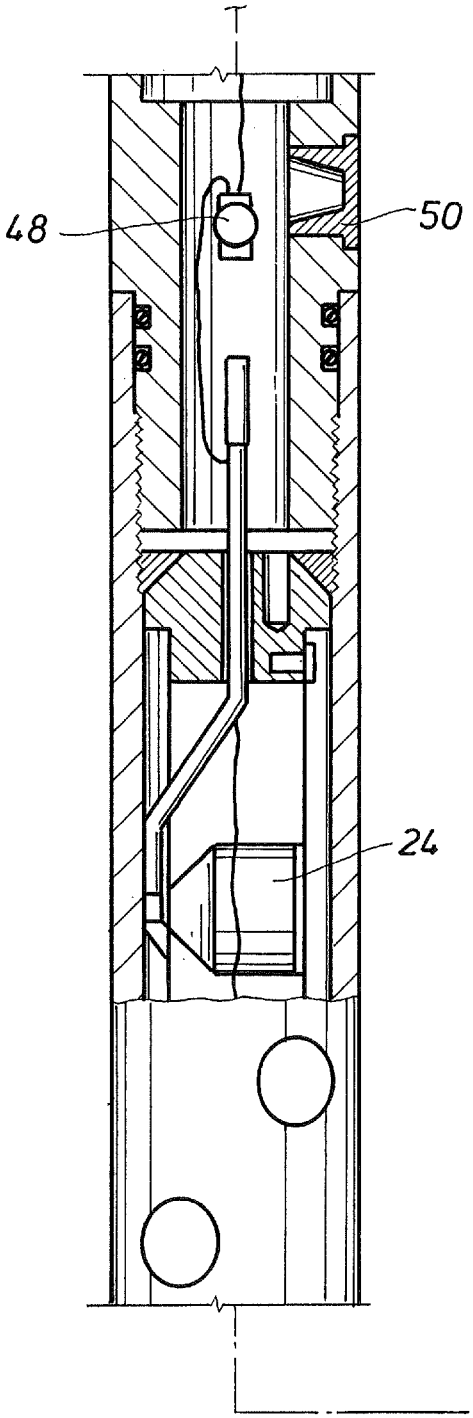
Figure 2D:
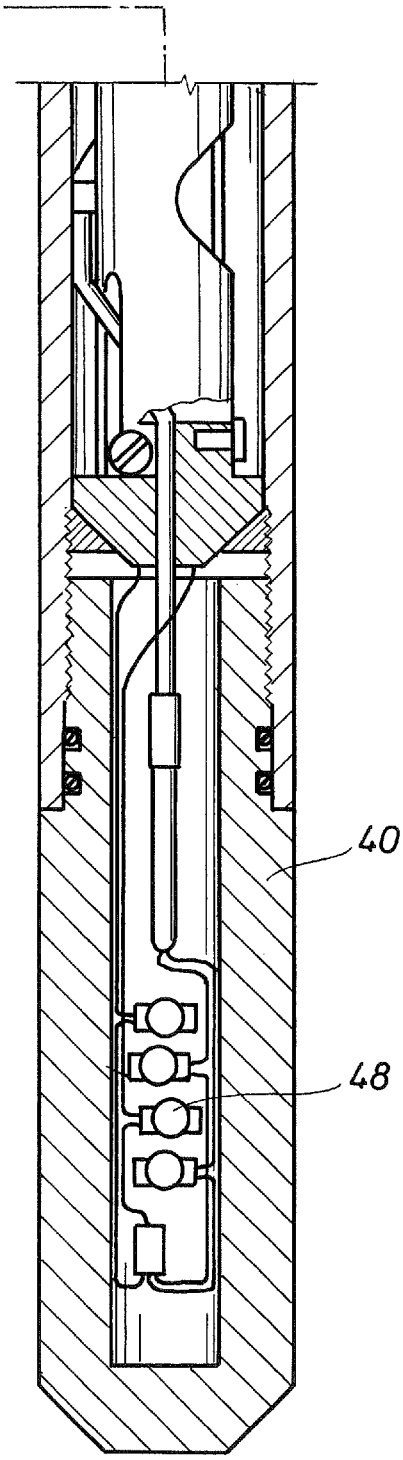

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

Figure 3:
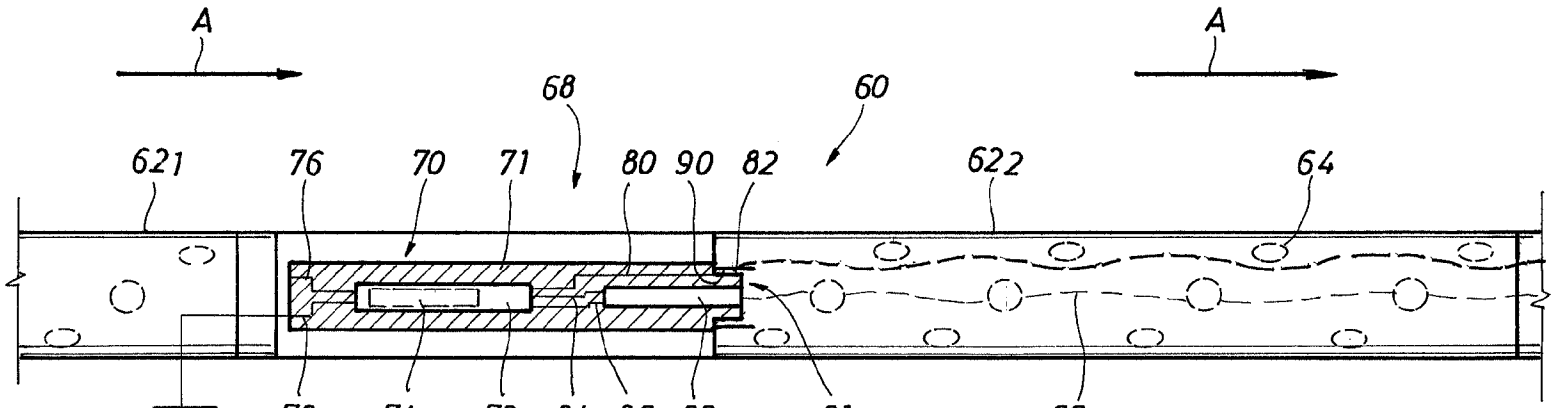
FIGS. 3 and 4 are side sectional views of a perforating system in accordance with the present disclosure.

In FIG. 3 an example embodiment of a perforating system 60 is shown in a side sectional view. In this example, the perforating system 60 includes perforating guns $\mathbf{62}_1$, $\mathbf{62}_2$ each having a series of shaped charges 64 disposed within. Each perforating gun $\mathbf{62}_1$, $\mathbf{62}_2$ further includes a detonating cord 66 disposed lengthwise therein so it is positioned proximate each of the shaped charges 64; thus when the detonating cord 66 is initiated, it may in turn initiate detonation of the shaped charges 64. Initiating the detonation cords 66 forms a pressure wave that travels the length of the detonation cords 66. In the example embodiment of FIG. 3, the pressure wave travels in the direction of arrows A, and as will be described in more detail below, an initiation signal reaches perforating gun $\mathbf{62}_1$ before reaching perforating gun $\mathbf{62}_2$. Thus for the purposes of reference only, perforating gun $\mathbf{62}_1$ is referred to as an "upstream" gun whereas perforating gun $\mathbf{62}_2$ is referred to as a "downstream gun".

Coupled in series with the downstream perforating gun $\mathbf{62}_2$ is a cartridge sub 68 having a cartridge assembly 70 set within the housing of the cartridge sub 68. In the embodiment of FIG. 3, the cartridge assembly 70 is shown made up of an elongated body 71, and within the body 71 are a switch assembly 72 and an optional circuit board 74 for selectively performing switching operations within the switch assembly 72. In one example of operation, the switch assembly 72 regulates transmission therethrough of electrical signals through the switch assembly 72 that are received by an inlet lead 76 in the cartridge sub 68 from the upstream perforating gun $\mathbf{62}_1$. The switch assembly 72 also includes a ground lead 78 on the side with the inlet lead 76; the ground lead 78 is selectively in electrical communication with the switch assembly 72 such as by the switching action provided by the circuit board 74. Exiting the switch assembly 72, on a side opposite the inlet lead 76, is a supply lead 80 that is in electrical communication with a communication line 82 shown extending within the downstream perforating gun $\mathbf{62}_2$. In an example embodiment, inlet lead 76 selectively couples with an electrical source for receiving electricity. Also exiting the switch assembly 72 are a signal lead 84 and a ground lead 86. In an example, the leads 84, 86 make up a detonator connection that provides selective electrical communication between the signal assembly 72 and a detonator 88 shown set in an end of the cartridge assembly 70 adjacent the downstream perforating gun $\mathbf{62}_2$. As illustrated in FIG. 3, the modular cartridge assembly 70 can be inserted within the annular cartridge sub 68 for easy assembly and removed from within the cartridge sub 68 for replacement and/or repair.

When an initiating signal is received by the switch assembly 72, the circuit board 74 operates to provide an initiating current through the signal line 84 and further allow continuity between the ground lead 86 and ground lead 78, thereby closing a circuit through the detonator 88 for initiating the detonator 88. As shown, an end of the detonator 88 is directed towards the detonating cord 66 within the downstream perforating gun $\mathbf{62}_2$, so that as the pressure wave of detonation passes along the length of the detonating cord 66, the attached shaped charges 64 will in turn initiate to create perforations in an adjacent formation (not shown). Further illustrated in the embodiment of FIG. 3, a collar-like connector 90 is provided on the downstream end 91 of the cartridge sub 68. In an example, the connector 90 is formed from a conductive material and is an annular member that circumscribes the downstream end 91. Further in the example of FIG. 3, the diameter of the cartridge sub 68 reduces at the downstream end 91. When the cartridge sub 68 is connected to the downstream perforating gun $\mathbf{62}_2$, connector 90 coaxially inserts within an annular electrical receptacle 92 shown provided in the downstream perforating gun $\mathbf{62}_2$. The electrical receptacle 92 is electrically conductive, so that the combination of the electrical receptacle 92 and connector 90 provides an electrical coupling between the exit lead 80 and communication line 82. The coupling thus provides a means for transferring a signal or signals between the cartridge sub 68 and the downstream perforating gun $\mathbf{62}_2$, and along the length of the perforating system 60. It should be pointed out that the orientation of the cartridge sub 68 and perforating guns $\mathbf{62}_1$, $\mathbf{62}_2$ is reversible; so that when a string of multiple guns is formed, the signal that passes along the signal lines and through the switch assembly 72 may start at the lower end of a perforating gun string and travel upwards, or initiate at the upper end of the string and travel downwards within the wellbore.

Figure 4:
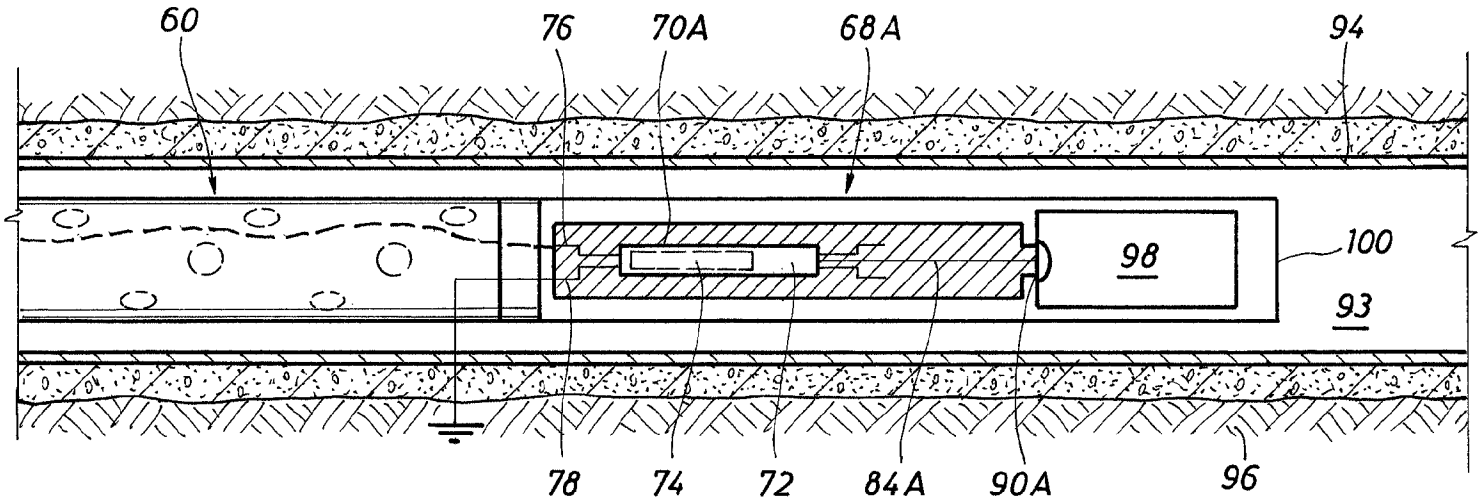

FIG. 4 illustrates an example embodiment of a lower end of the perforating system 60 and with an alternate embodiment of a cartridge sub 68A. In this example, an inlet lead 76 and ground lead 78 extend through the cartridge assembly 70A to a switch assembly 72. However, the exit or downstream side of the switch assembly 72 includes a single continuous signal line 84A that terminates at a connector 90A. The example of the connector 90A illustrated in FIG. 4 is a hemispherical-shaped member with a collar-like base circumscribing a cylindrical tip of the cartridge assembly 70A. Similar to the connector 90 of FIG. 3, connector 90A of FIG. 4 is formed from an electrically conducting material. Further, in the embodiment of FIG. 4, the perforating system 60 is set within a wellbore 93 lined with casing 94 that is cemented within the formation 96. In this embodiment, a bridge plug 98 is shown set within a bridge plug sub 100 to form a bridge plug setting tool mounted on the end of the cartridge sub 68A having the connector 90A. Optionally, some other pressure actuated device may be provided on the end of the cartridge sub 68A. In the example of FIG. 4, the connector 90A contacts an igniter (not shown) in the bridge plug sub 100 thereby providing electrical continuity between the signal line 84A and the igniter. Delivering an electrical signal or electricity can activate the igniter for setting the bridge plug 98. Setting the bridge plug 98 can cause it to expand from within the bridge plug sub 100 and into contact with the inner circumference of the casing 94, thereby pressure isolating that section of the wellbore from another.

In one example embodiment, the connection between the cartridge sub 68 and upstream perforating gun may be a terminal assembly made up of a rod and pin connector, where the pin connector is mounted on a free end of the rod. In this example, a bushing circumscribes a mid-portion of the rod. The pin connector is in electrical communication with connector in the sub 68 by connections that extend through the end wall of the sub 68. Circumscribing the portion of the terminal assembly adjacent the end wall is a spring connector that is in electrical communication with another connector in the sub 68 by connections extending through the end wall. Provided at a downstream end of the cartridge sub 68 opposite the terminal assembly is a downstream connector in which the exit lead 80 is connected at an end opposite its connection to the switch assembly 72. Coaxially projecting from the end of the cartridge sub 68 and adjacent the detonator 88 is a spring connector; the spring connector communicates with the downstream connector by connection through the end wall at the downstream end of the sub 68.

The spring connectors can provide connectivity on the upstream and downstream sides of the cartridge sub 68. More specifically when the cartridge sub 68 is inserted within an example embodiment of a perforating string 60, a connector sub couples to the upstream end of the cartridge sub 68 and receives the terminal assembly, within an axial bore formed through the connector sub. A receptacle is formed within the connector sub at a location set back from the entrance to the bore. The receptacle provides terminals for communication between a signal wire within the connector sub and the pin connector. As such, a signal traveling through the signal wire is transmitted through the terminals to the pin connector for delivery to the switch assembly. Also the insertion of the downstream side of the cartridge sub 68 into an end of the downstream perforating gun $\mathbf{62}_2$. A connection assembly may be set within a bore formed in the end of the downstream perforating gun $\mathbf{62}_2$. The connection assembly can be made up of a disc-like flange member set into close contact with the spring connector. A cylindrically-shaped base may depend coaxially from a side of the flange opposite the spring connector and set within a reduced diameter portion of the bore. Setting the base and bore diameters at about the same value anchors the connector assembly within the perforating gun $\mathbf{62}_2$. A communication line, similar to the line 82 of FIG. 3, may attach to the flange thereby providing communication from the exit lead 80, through the assembly of connectors and spring connector, flange, and into and through the perforating gun $\mathbf{62}_2$.

Figure 5:
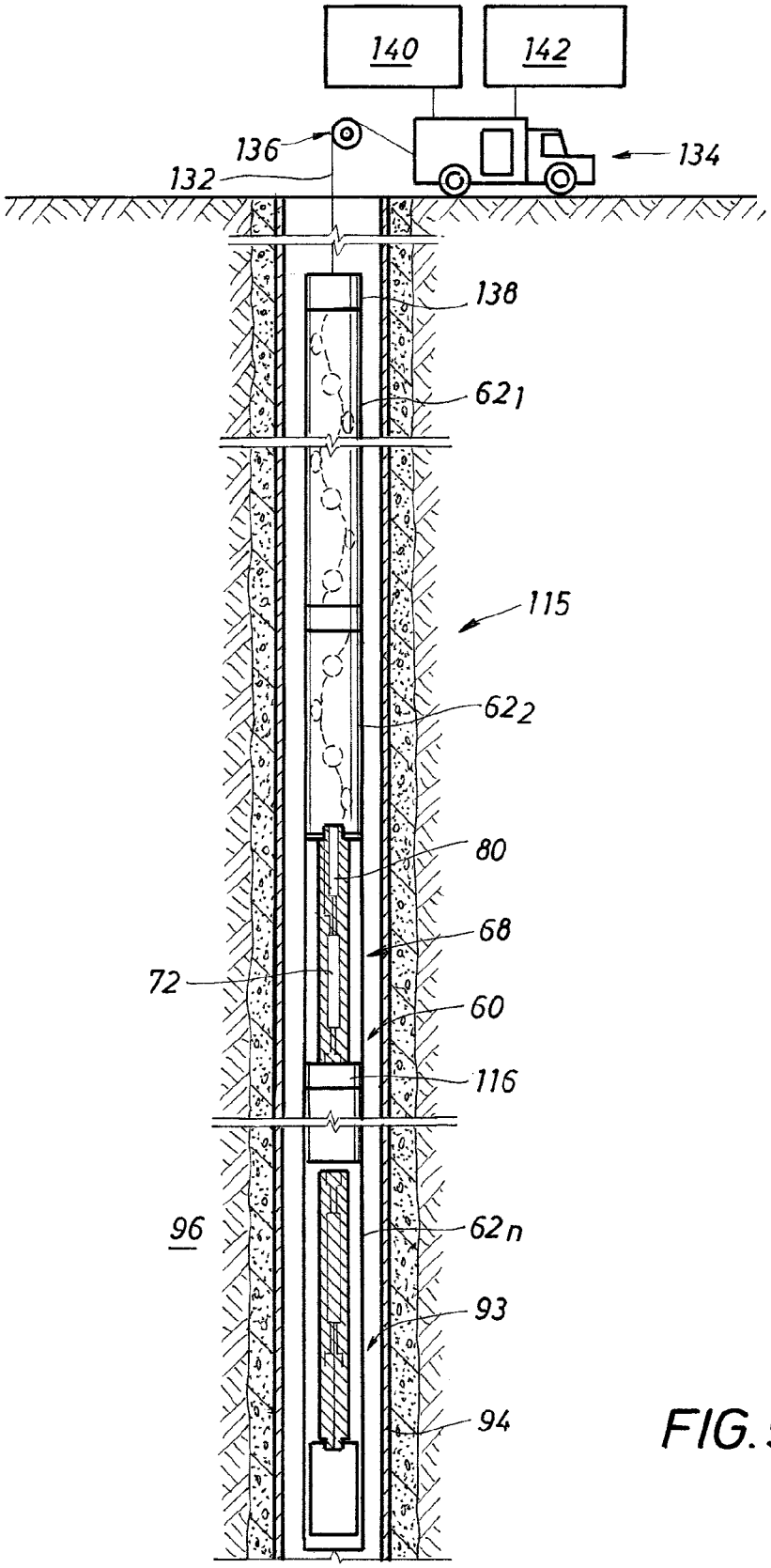
FIG. 5 is an example of a perforating string disposed in a wellbore in accordance with the present disclosure.

One example of a substantially complete perforating system 60 in accordance with the present disclosure is shown in a partial sectional view in FIG. 5. In this example, a string 115 of perforating guns $\mathbf{62}_{1\text{-}n}$ is disposed within wellbore 93 for perforating through the casing 94 and into the surrounding formation 96. Further in this example, the cartridge sub 68 and the string are oriented so that signals received in the switch assembly 72 are from a location farther downhole; thus signals traveling in the string in a direction towards the surface. Depending on the instructions programmed into the switch assemblies 72, the direction of perforating may also travel upwards within the bore hole 92 rather than from the top to the bottom.

In one example, the string 115 is assembled by providing cartridge subs 68 with a cartridge 70 within. Each of the cartridge subs 68 can then be coupled with a perforating gun 62 so connectors 90 in their respective downstream ends 91 mate into electrical receptacles 92 as illustrated in FIG. 3. Connector subs 116 may optionally be provided for coupling upstream ends of the cartridge subs 68 with an upstream perforating gun. As described above, engaging the cartridge sub 68 with the downstream perforating gun provides a generally seamless way of forming an electrical connection between adjacent bodies in a perforating string. Moreover, the electrical connection occurs substantially simultaneously with coupling of the cartridge sub 68 and perforating gun 62, so that manually forming electrical connections is unnecessary. Thus by connecting a repeating series of perforating guns 62 and cartridge subs 68, the string 115 can be formed so that electrical communication extends substantially the length of the string 115 via contact between successive connectors 90 and receptacles 92.

Further illustrated in the example embodiment of FIG. 5 is a wire line 132 shown suspending the string of perforating guns 62 that is controlled from a surface truck 134. An optional pulley system 136 aligns the wire line 132 above the wellbore 93. An attachment sub 138 is provided on an upper end of the string for attachment and electrical connection between the perforating gun 62 and wire line 132. A power source 140 and controller 142 are schematically depicted in communication with the surface truck 134. The power source 140 and controller 142 also may selectively connect with the wireline 132. While shown adjacent the surface truck 134, the power source 140 and controller 142 may instead be housed in the surface truck 134. In one optional embodiment, the controller 142 can generate and/or send control signals to the perforating gun string 115 via the wireline 132. Thus examples exist wherein each cartridge sub 68 in the string 115, and all components in each cartridge sub 68, are in signal communication with the controller 142 by virtue of the connectivity between the connectors 90 and receptacles 92. Similarly, electricity from the power source 140 can be delivered throughout the perforating string 115 and components therein for initiating detonation of the detonators 88 and bridge plug 98.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the signals may include instructions for selective operation of the switch assemblies, may include electricity, or may be in the form of a pressure wave within a detonation cord. Optionally, instructions may be provided in the switch assemblies, either by storing the instructions in hardware, such as the circuit boards, or by signals traveling in the perforating string. Moreover, the connection embodiments described above may be used for connecting to any ballistic device in a downhole string. Examples include release tools, multiple backoff shots, firing heads, redundant firing heads, severing tools, setting tools, combinations thereof, and the like. These and other similar modifications will readily suggest themselves to those skilled in the art, and are intended to be encompassed within the spirit of the present invention disclosed herein and the scope of the appended claims.

What is claimed is:

1. A perforating string insertable into a wellbore comprising:

an upstream perforating gun;

a downstream perforating gun having an upstream end, an annular receptacle fitting in the upstream end, a communication line with an end electrically connected to the receptacle fitting, and a detonating cord;

a cartridge sub; and a cartridge assembly that selectively inserts into in the cartridge sub and that comprises:

a body, a detonator in the body and having a detonating end adjacent to and directed towards the detonating cord, a signal line connected to the detonator;

an annular connector that circumscribes an end of the body that selectively inserts into electrical communicating contact with the receptacle fitting, and a switch assembly in the body and in communication with the upstream perforating gun, and in selective communication with the signal line and in selective communication with the communication line via the selective communicating contact between the connector and the receptacle fitting, so that when an electrical signal is communicated to the switch assembly from the upstream perforating gun, the electrical signal is selectively communicated to the signal line to initiate the detonator and detonating cord in the downstream perforating gun, and the electrical signal is selectively communicated to the communication line.

2. The perforating string of claim 1, wherein an electrical coupling is formed when the connector inserts into the receptacle, and wherein the communication line is in communication with a perforating gun that is downstream of the downstream perforating gun.

3. The perforating string of claim 1, further comprising a circuit board in the switch assembly for selectively providing communication to the signal line and to the communication line.

4. The perforating string of claim 3, further comprising a ground lead connected between the detonator and the switch, wherein the switch selectively communicates the ground lead to ground.

5. The perforating string of claim 3, further comprising a transfer lead line having an end in selective communication with an electrical source and another end in communication with a connector for selectively providing communication between the electrical source and the signal line.

6. The perforating string of claim 1, further comprising a downstream cartridge sub and an inlet line in electrical communication with the signal line, an outlet lead line in communication with a bridge plug assembly, so that when an electrical signal is applied to the signal line, the electrical signal is transferred through the downstream cartridge sub to the bridge plug assembly for deploying a bridge plug in the bridge plug assembly.

7. A connector assembly for connecting an upstream perforating gun to a downstream perforating gun comprising:

an annular housing;

a modular and elongated cartridge body removeably inserted within the housing;

an annular connector provided on a downstream end of the body and inserted into electrical contact with a receptacle in the downstream perforating gun;

a detonator in the cartridge body for initiating a detonating cord in the downstream perforating gun; and a switching assembly in the cartridge body that is in electrical communication with the detonator through the electrical contact between the connector and the receptacle, and that is for receiving a signal from the upstream perforating gun, selectively communicating a signal to the detonator for initiating the detonator, and selectively communicating to a communication line in the downstream perforating gun.

8. The connector assembly of claim 7, further comprising a circuit board in the switch assembly for controlling operation of the switch assembly.

9. The connector assembly of claim 8, further comprising an outlet line that connects between the switch and the detonator, and a ground line that connects between the switching assembly and ground, so that when a detonation signal and detonation current is sent to the switching assembly, the inlet line, outlet line, and ground line form a circuit for flowing current through the detonator for initiating detonation of the detonator and the detonating cord.

10. A method of perforating comprising:

providing a downstream perforating gun with shaped charges, a detonation cord, an annular receptacle connection, and a signal line in communication with the receptacle connection;

providing a cartridge sub having an upstream end and a downstream end;

providing a cartridge assembly that comprises an annular connector, a switching assembly, and a lead line electrically connected to the connector;

electrically coupling the connector with the signal line by inserting the cartridge assembly into the cartridge sub that in turn inserts the connector into the receptacle connection so that the connector is electrically coupled with the receptacle connection; and receiving a signal in the switching assembly that is from an upstream perforating gun that is upstream of the downstream perforating gun;

sending a signal to the downstream perforating gun in response to the step of receiving the signal;

detonating the shaped charges by providing a detonation signal to the detonator in response to a signal received by the switching assembly.

11. The method of claim 10, wherein the step of providing a detonation signal to the detonator comprises directing electricity from an electrical source to an inlet line connected to the detonator.

12. The method of claim 11, wherein the switch assembly selectively provides electrical communication between the electrical source and the detonator, and for providing electrical communication between an outlet line on the detonator and ground for completing an electrical circuit through the detonator.

* * * * *